US010959504B2

(12) United States Patent
Genelot et al.

(10) Patent No.: US 10,959,504 B2
(45) Date of Patent: Mar. 30, 2021

(54) MECHANISM FOR A CASE FOR APPLYING A COSMETIC PRODUCT, IN PARTICULAR A LIPSTICK, AND CASE INCLUDING SUCH A MECHANISM

(71) Applicant: ALBEA SERVICES, Gennevilliers (FR)

(72) Inventors: Pascal Genelot, Château-Gontier (FR); Yicheng Dong, Shanghai (CN)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 16/277,555

(22) Filed: Feb. 15, 2019

(65) Prior Publication Data

US 2019/0246769 A1 Aug. 15, 2019

(30) Foreign Application Priority Data

Feb. 15, 2018 (FR) ..... 1851272

(51) Int. Cl.

| | |
|---|---|
| ***A45D 40/06*** | (2006.01) |
| ***A45D 40/04*** | (2006.01) |
| ***A45D 40/20*** | (2006.01) |
| *A45D 40/00* | (2006.01) |

(52) U.S. Cl.

CPC ..... *A45D 40/06* (2013.01); *A45D 40/04* (2013.01); *A45D 40/205* (2013.01); *A45D 2040/0018* (2013.01); *A45D 2040/208* (2013.01)

(58) Field of Classification Search

CPC ... A45D 40/04; A45D 40/06; A45D 2040/208
See application file for complete search history.

(56) References Cited

U.S. PATENT DOCUMENTS

| | | | | |
|---|---|---|---|---|
| 3,758,218 | A * | 9/1973 | Pfrommer | A45D 40/06 401/86 |
| 4,983,059 | A * | 1/1991 | Holloway | A45D 40/06 401/74 |
| 5,873,667 | A * | 2/1999 | Inoue | A45D 40/06 401/78 |
| 6,227,733 | B1 * | 5/2001 | Holloway | A45D 40/04 132/318 |
| 6,543,952 | B1 * | 4/2003 | Ohba | A45D 40/04 401/174 |
| 7,147,393 | B2 * | 12/2006 | Yoon | A45D 40/04 401/98 |

(Continued)

FOREIGN PATENT DOCUMENTS

| | | |
|---|---|---|
| FR | 3036266 | 11/2016 |
| FR | 3048346 | 9/2017 |
| FR | 3052345 | 12/2017 |

*Primary Examiner* — David P Angwin
*Assistant Examiner* — Bradley S Oliver
(74) *Attorney, Agent, or Firm* — Steven M. Greenberg, Esq.; Shutts & Bowen LLP

(57) ABSTRACT

A mechanism for a case for applying a cosmetic product having a main axis includes a sleeve arranged around a head of a guide to which the sleeve is secured. The head of the guide includes snap-fitting attachment means configured to cooperate with complementary means of the sleeve in order to axially immobilize the sleeve with respect to the guide, and rotational blocking means intended to cooperate with the complementary means of the sleeve to rotationally block the sleeve with respect to the guide.

12 Claims, 5 Drawing Sheets

(56) References Cited

U.S. PATENT DOCUMENTS

| | | | | |
|---|---|---|---|---|
| 7,309,184 | B2 * | 12/2007 | Butcher | A45D 34/04<br>401/172 |
| 9,474,351 | B2 * | 10/2016 | Chen | A45D 40/02 |
| 2007/0147948 | A1 * | 6/2007 | Murakoshi | A45D 40/16<br>401/175 |
| 2020/0085167 | A1 * | 3/2020 | Vacheron | A45D 40/06 |

* cited by examiner

MECHANISM FOR A CASE FOR APPLYING A COSMETIC PRODUCT, IN PARTICULAR A LIPSTICK, AND CASE INCLUDING SUCH A MECHANISM

CROSS REFERENCE TO RELATED APPLICATIONS

This application claims priority under 35 U.S.C. ¬ß119(a) to French Patent Application Number 1851272, filed Feb. 15, 2018, the entire teachings of which are incorporated herein by reference.

BACKGROUND OF THE INVENTION

Field of the Invention

The invention relates to a mechanism for a case for applying a cosmetic product, in particular lipstick, and a case that includes such a mechanism.

Description of the Related Art

The state of the art discloses examples of mechanisms of the same type used in a case for the packaging of a cosmetic product, in particular for a lipstick, but not exclusively. The mechanism of the case makes it possible to selectively move the cosmetic product from a retracted position to an application position where the cosmetic product is likely to be applied by friction. The actuation of the mechanism is generally controlled manually by applying a rotational motion to the base of the case, the rotational motion being transmitted to the mechanism to cause the axial movement of the cup including the cosmetic product.

A mechanism of the type described above including a sleeve is in particular, but not exclusively, used when the cosmetic product has a formulation called "soft" or "very soft". With such formulations, the cosmetic product is thus directly in contact with a part of the inner wall of the sleeve to ensure the cosmetic product is supported. Indeed, and by comparison with other formulations, such soft formulations of a cosmetic product are unlikely to be packaged in the form of a bullet-shaped stick that has sufficient mechanical strength, in particular during the application of the cosmetic product. This is why the cosmetic product is surrounded by a sleeve.

The cosmetic product is generally cast directly into the sleeve, for example through the cup of the mechanism. A different design to integrate such a sleeve, also called "A-shell", in a mechanism is also known. According to a first design, the sleeve is formed of a single part, or single-block assembly, with the guide of the mechanism. Yet, the sleeve is an aesthetic part since such a sleeve is visible, as it extends outside of the base of the case inside which the remainder of the mechanism is housed. This is the reason why the sleeve is generally made of a metal material, such as anodized aluminium, to preserve the aesthetic quality of the case of which the base and the lid are often made of "precious" materials.

In addition, the use of a metal material for the sleeve improves the cooling of the formulation of the cosmetic product after it has been cast, as well as the appearance thereof, and in particular makes it possible to shorten the time of the production cycle. In a non-limiting manner, published French Patent Application FR-2.955.469 describes an example of an embodiment of a mechanism according to this first design. In this document, the upper part of the tubular body constitutes a sleeve, while the lower part constitutes a guide for a cup which is made of two parts. Indeed, the lower part of the cup, which is described in the document as being the rod, is intended to be connected to an upper part described as being the bucket. This first design of the sleeve and the guide as a single part furthermore has the disadvantage of using the same material for the entire part. Yet, the use of a metal material for the entire part increases costs, although this is not necessary for the guide, in particular due to the fact that the guide is not a part of the mechanism that is seen by the user of a case.

According to a second design, the sleeve and the guide are made in the form of two separate parts. This second design thus makes it possible to freely select the material of each of the parts, typically a metal material for the sleeve and a plastic material for the guide of the mechanism. In such a design, both parts must however be secured to one another. The state of the art discloses various solutions to secure the sleeve to the guide, the solutions being to perform a connection by gluing or crimping. Such connections achieved by gluing or crimping have the advantage of both providing an axial connection and a rotational connection between the sleeve and the guide.

However, each of these solutions also has disadvantages, in particular risks of pollution of the cosmetic product. The use of glue induces risks of polluting the cosmetic product with the glue, the quantity and distribution of which during assembly is difficult to control with great accuracy. Stamping sometimes leads to the formation of chips, in particular when the sleeve has a finish coat deposited by anodising. In addition, crimping is a difficult operation to control, in particular when both parts are made of different materials with a guide made of a plastic material. The purpose of the invention is, in particular, to propose a new design of the mechanism, which will overcome, at least partially, the disadvantages associated with the state of the art, while providing a connection between the sleeve and the guide that remains advantageously simple, reliable, and inexpensive to produce.

BRIEF SUMMARY OF THE INVENTION

For this purpose, the invention proposes a mechanism for a case for applying a cosmetic product of the type described above, characterized in that the head of the guide includes:

- snap-fitting attachment means configured to cooperate with complementary means of the sleeve in order to axially immobilize the sleeve with respect to the guide, and
- rotational blocking means intended to cooperate with the complementary means of the sleeve to block the sleeve rotationally with respect to the guide.

Advantageously, the mechanism includes snap-fitting attachment means to axially immobilize the sleeve with respect to the guide and rotational blocking means to block the sleeve rotationally with respect to the guide. Such snap-fitting attachment means are respectively supported by the guide and the sleeve intended to be axially immobilized together.

Advantageously, the snap-fitting attachment means being implemented between the guide and the sleeve are configured to obtain a non-removable attachment. The snap-fitting attachment means according to the invention make it possible for the attachment of the sleeve and the guide, in particular to ensure sufficient strength in the case of an upwards axial tractive effort, for example exerted on the sleeve, while the guide remains maintained.

Advantageously, the rotational blocking means of the sleeve are separate from the snap-fitting attachment means. Each of the blocking functions of the sleeve with respect to the guide, respectively axially and rotationally, is therefore ensured by different means.

Advantageously, the guide is made of a plastic material such that the at least one flexible tab forming the attachment means and the blocking means is integrally formed as a single part with the guide.

Preferably, the snap-fitting attachment means include at least two flexible tabs that are arranged on the head of the guide, diametrically opposite one another, in particular for the purpose of balancing the immobilizing forces.

Advantageously, the sleeve is made of a metal material, such as anodized aluminium.

According to other characteristics of the invention:

- the by snap-fitting attachment means include at least one flexible tab that is elastically deformable in a radial direction, the flexible tab including a free end received in an associated opening of the sleeve to axially immobilise the sleeve with respect to the guide;
- the snap-fitting attachment means include at least two flexible tabs that are elastically deformable in a radial direction;
- the at least one flexible tab extends along an axial direction;
- the free end of the at least one flexible tab includes an upper assistance face configured to facilitate the elastic deformation of the tab, radially inwards, when the sleeve cooperates with the upper assistance face during the axial assembly of the sleeve with the guide;
- the at least one flexible tab is returned elastically, radially outwards, so as to be housed automatically in the associated opening of the sleeve during the axial assembly of the sleeve with the guide;
- the free end of the at least one flexible tab includes at least one lower immobilizing face configured to cooperate with an associated edge of the opening of the sleeve so as to axially immobilize the sleeve with respect to the guide;
- the at least one lower immobilizing face includes at least one notch;
- the outer diameter of the guide at the level of the at least one flexible tab is, in an assembled position, less than or equal to the outer diameter of the sleeve;
- the head of the guide includes a radial collar including an upper face that forms an axial abutment for the sleeve during the assembly thereof with the guide;
- the head of the guide includes at least two ribs for guiding the sleeve;
- the at least two guiding ribs are preferably arranged diametrically opposite one another;
- the head of the guide is configured such that the at least one flexible tab has, radially with respect to the cup, a space that is determined to obtain a non-removable attachment of the sleeve on the head of the guide;
- the rotational blocking means are configured to index the position of the sleeve with respect to the head of the guide so as to angularly position each of the openings radially opposite the free end of the at least one flexible tab;
- the rotational blocking means include at least one axial finger received, in an assembled position, in an indentation of the sleeve.

The invention also proposes a case for applying a cosmetic product including a lid and a base including a mechanism according to the invention, characterized in that the sheath of the mechanism is rotationally connected to the base of the case.

Advantageously, the sheath of the mechanism is rotationally connected to the base of the case by form-fitting.

Preferably, the sheath of the mechanism and the base of the case are rotationally connected by complementary gearing means arranged on each of the parts.

The gearing means are, for example, made by splines which, secured to the base of the case, are intended to cooperate with striations supported by a knob provided on the sheath of the mechanism.

Advantageously, in an assembled position, the flexible tabs are not in contact with the cup so as to avoid any interference that is likely to change the rotational torque to be applied to the base to cause the axial movement of the cup.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Conventionally, the "axial" direction corresponds to that of the main axis O shown in the figures and the "radial" direction is orthogonal to the axial direction.

In the following detailed description of the figures, the terms "upper" and "lower", and the terms "top" and "bottom" are used, in a non-limiting manner, with reference to the axial direction.

In the same manner, the terms "inner or outer" and "inside or outside" are used with reference to the radial direction, an outer element being more radially distant from the axis O than an inner element.

Figure 1:
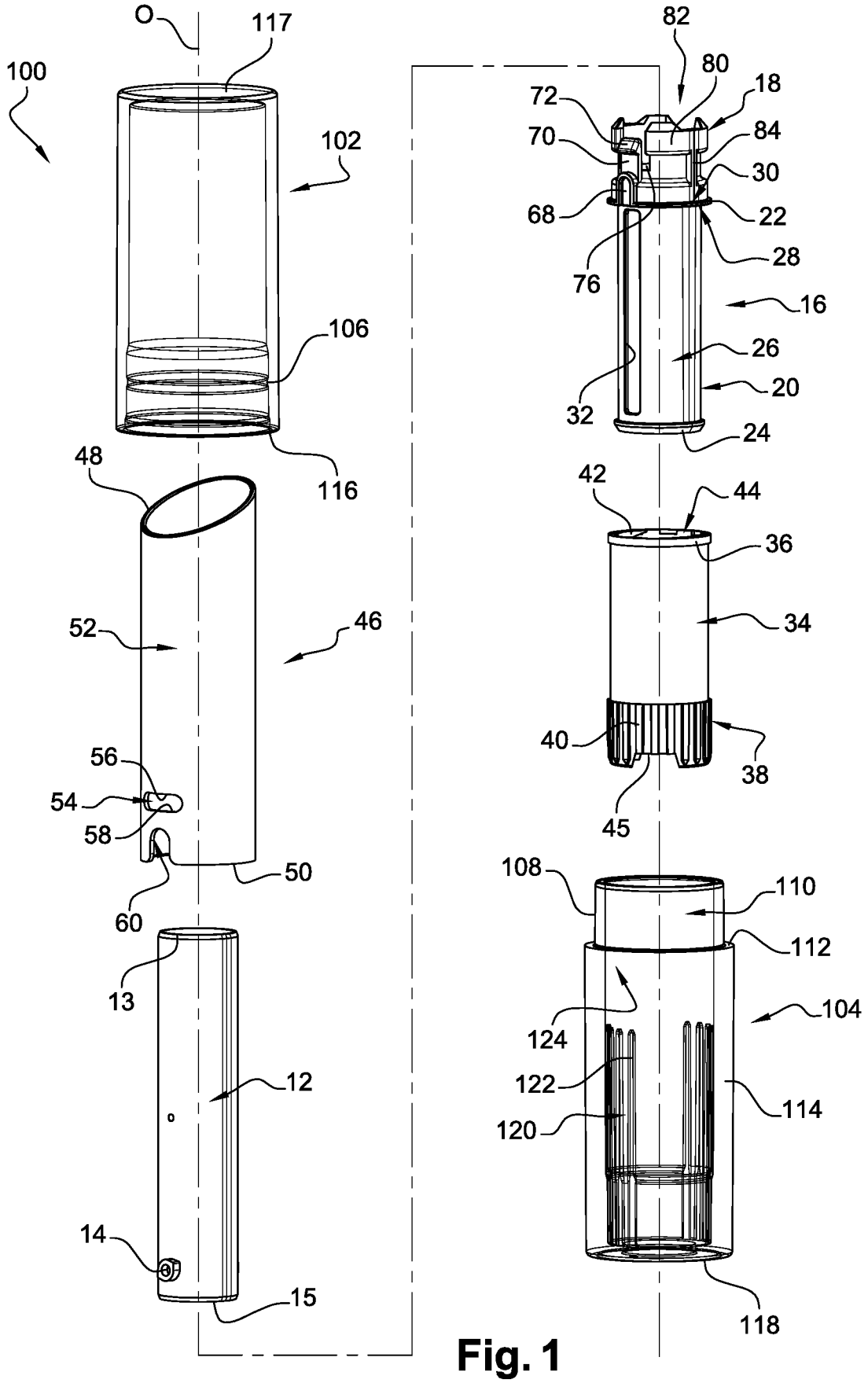
FIG. 1 is an exploded view which shows an example of a case for applying a cosmetic product and illustrating the various parts of a mechanism according to an embodiment of the invention.
Figure 2:
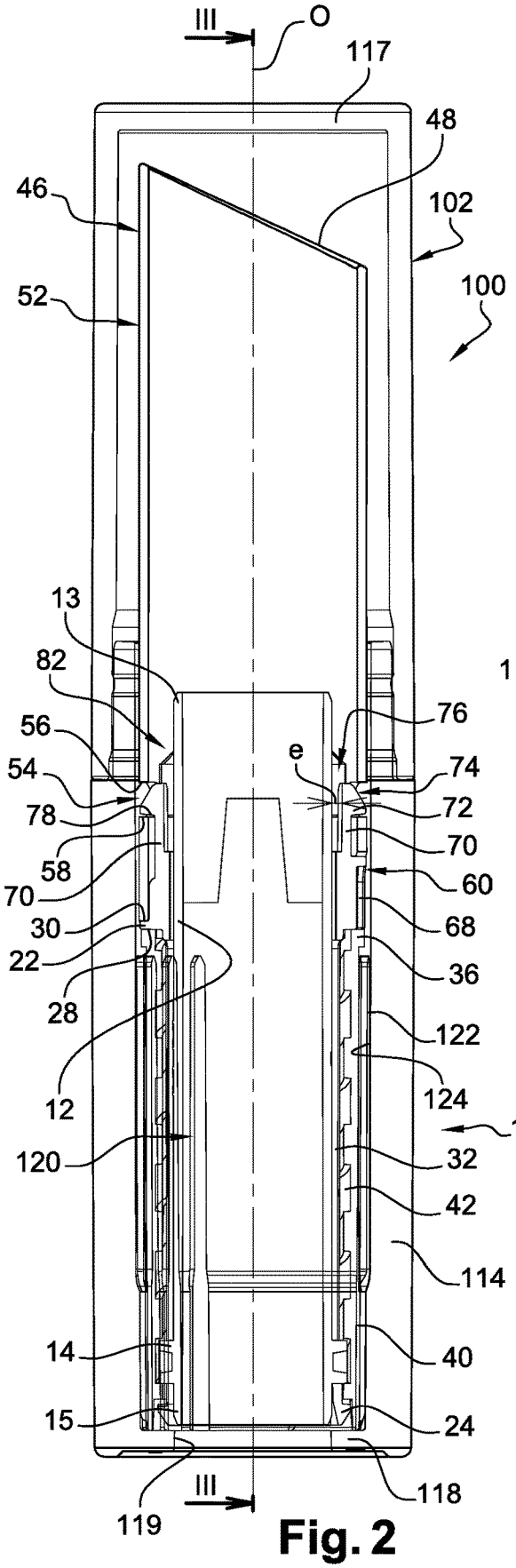
FIGS. 2 and 3 are axial cross-sectional views respectively along the plane II-II and the plane III-III which show a case according to FIG. 1 with the lid in a closed position and which illustrate, after assembly, the mechanism including a guide wherein the head includes attachment means and rotational blocking means to secure the guide to the sleeve.
Figure 3:
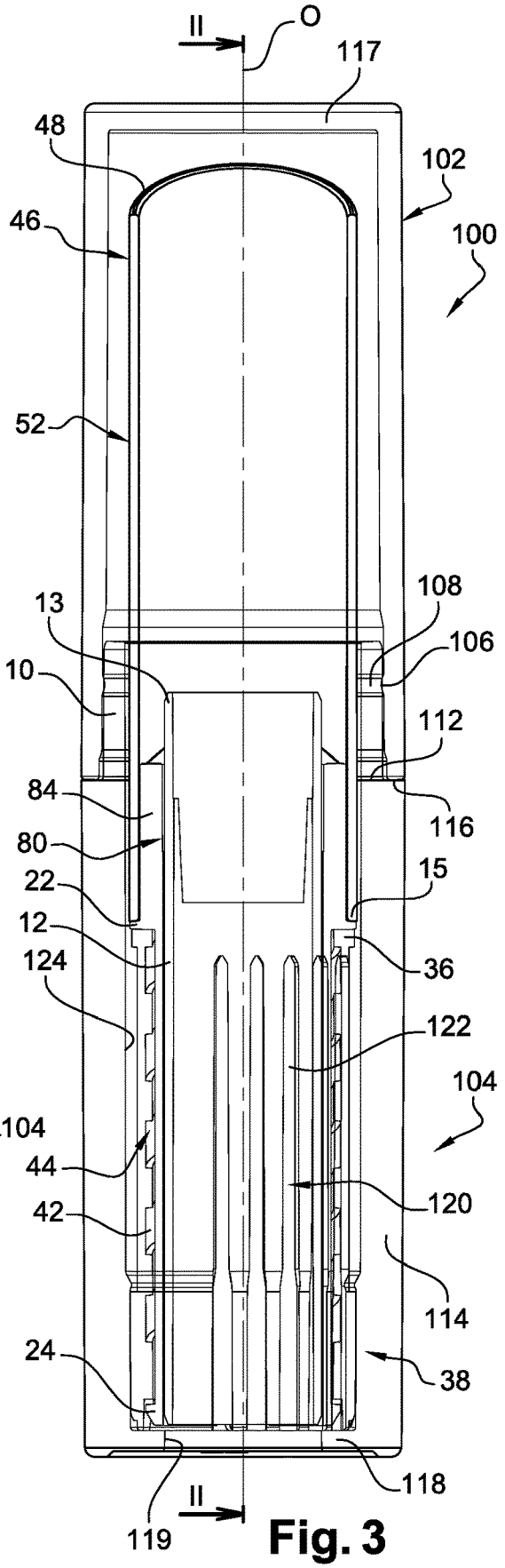

FIGS. 1 to 3 show an embodiment example of a case 100 for applying a cosmetic product (not shown).

In the embodiment example, the cosmetic product is a lipstick intended to be applied by friction or, alternately, a lip care balm.

The case 100 includes at least one lid 102 associated with a base 104 having a complementary shape. The case 100 has a main axis O that extends in the radial direction.

In a non-limiting manner, the lid 102 and the base 104 of the case 100 have a cylindrical shape with a circular cross-section, in particular shown in FIG. 1.

Preferably, the lid 102 is removable and forms a part that is fully independent from the base 104.

The lid 102 is likely to occupy at least one open position (not shown) wherein the lid 102 is separated from the base 104 in particular to make it possible for the application of the cosmetic product.

The lid 102 is likely to occupy a closed position shown in FIGS. 2 and 3 wherein the lid 102 is secured to the base 104.

The lower part of the lid 102 includes inside at least one annular protrusion 106.

Preferably, the at least one protrusion 106 is received in an annular groove 108, for example provided in an outer cylindrical surface of an upper part 110 of the base 104.

Alternately, the at least one protrusion 106 cooperates with the outer cylindrical surface of an upper part 110 of the base 104.

The annular protrusion 106 is in particular shown in FIG. 1 by the transparency of the lid 102.

Advantageously, the annular protrusion 106 ensures the axial support of the lid 102 on the base 104 in a closed position.

Advantageously, the annular protrusion 106 helps to achieve an air-tight seal to guarantee the proper conservation of the cosmetic product.

The base 104 includes a shoulder 112 that extends radially at the level of the connection of the upper part 110 of the base 104 with a lower part 114 having a greater diameter.

The lid 102 includes a lower edge 116 that is likely to abut against the shoulder 112 in a closed position.

The lid 102 and the base 104 are hollow parts, the lid 102 is closed at the upper end thereof by a top wall 117, while the base 104 is closed at the lower end thereof by a bottom 118.

Advantageously, the bottom 118 includes a central orifice 119 for the hot casting of the cosmetic product.

The diameter of the orifice 119 is determined to make it possible for the axial introduction of a tube for the hot casting of the cosmetic product.

The lower part 114 of the base 104 includes inside a part of the gearing means 120.

In the example, the gearing means 120 are further formed by axial splines 122 protruding with respect to an inner cylindrical wall 124 of the lower part 114 of the base 104, the assembly being shown in FIG. 1 by transparency of the base 104.

Preferably, the axial splines 122 are distributed circumferentially in two sectors diametrically opposite one another, each splined sector including, in this example, five splines 122.

Alternately, the assembly formed by the inner cylindrical wall 124 of the lower part 114 of the base 104 circumferentially includes the splines 122.

The case 100 which has just been described above is intended to receive a mechanism 10 for the dispensing of the cosmetic product.

The mechanism 10 is intended to be able to be changed, in particular but not exclusively when the cosmetic product has been fully used, so as to continue being able to use the case 100 with a new mechanism 10, forming a refill.

Such a mechanism 10 and the general functioning thereof are known from the state of the art, in particular for dispensing a cosmetic product such as a lipstick.

The mechanism 10 described below is however only provided by way of an example, and is not limited thereto.

The mechanism 10 includes a cup 12 intended to receive at least a part of the cosmetic product.

In the example, the cup 12 is made of one single part having a generally tubular shape extending axially and respectively delimited by an upper edge 13 and by a lower edge 15.

Like the central orifice 119 of the base 104 of the case 100, the cup 12 includes centrally a passage, the entrance of which is circumferentially delimited by the edge 15 and through which the hot casting of the cosmetic product is performed.

The mechanism 10 being mounted in the base 104, the case 100 is for example turned over so as to be oriented with the bottom 118 upwards to then perform the hot casting of the cosmetic product axially from top to bottom, i.e. advantageously using gravity.

The hot casting of the cosmetic product is generally performed by means of a tube, the free end of which is preferably introduced through the orifice 119 and then through the cup 12 to reach a sleeve of the mechanism 10, which will be described below.

The cup 12 includes at least one lug 14, preferably, in this example, two lugs 14, diametrically opposite one another, protruding radially outwards.

Preferably, the lugs 14 have, in cross-section, a non-circular profile. Advantageously, the lugs 14 include at least one flat spot intended to cooperate with at least one helical groove of a sheath that will be described below.

In an alternative (not shown), the cup 12 is made of two parts, respectively an upper cup intended to receive the cosmetic product and a lower cup, in some cases also called "cup engine". The lower cup then includes the lug or lugs 14 intended to cooperate with the other parts of the mechanism 10.

In such an alternative, both parts of the cup 12 are secured to one another, by snap-fitting for example.

The cup 12 is intended to be mounted axially mobile inside a guide 16, respectively between at least one retracted position shown in FIGS. 2 and 3 and one application position (not shown).

The guide 16 constitutes a first element of the mechanism 10 for dispensing the cosmetic product.

The guide 16 includes mainly an upper part, which hereinafter will be described as being a head 18 and that is extended axially by a lower part, which hereinafter will be described as being a body 20.

The body 20 extends axially between a collar 22 and a lower edge 24, the collar 22 ensuring at the upper end thereof, the junction with the head 18.

The collar 22 and the edge 24 protrude axially outwards with respect to an outer cylindrical surface 26 of the body 20 of the guide 16.

In the example, the collar 22 is circumferentially continuous and includes a lower face 28 and an upper face 30.

The body 20 of the guide 16 includes at least one rail 32 that extends axially in a rectilinear manner and wherein one of the lugs 14 of the cup 12 slides axially during operations.

In the example, the body 20 of the guide 16 includes two rails 32 which, diametrically opposite one another, each receive one of the lugs 14 of the cup 12 after the assembly thereof inside the body 20 of the guide 16.

Figure 4:
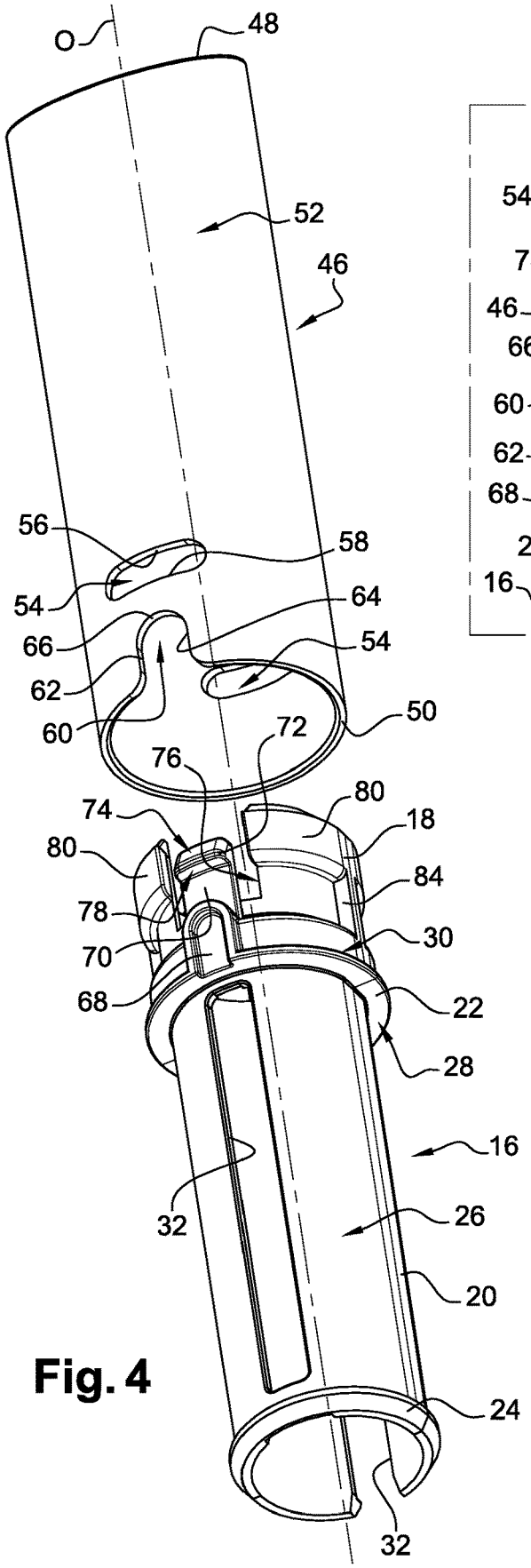
FIG. 4 is an exploded view which shows, in a perspective view, only the sleeve and the guide and which partially illustrates the attachment means formed by a pair of flexible tabs that are elastically deformable in the radial direction, and the complementary rotational blocking means.

Such as shown in FIG. 4, one of the rails 32 is axially open at the lower end thereof, intersecting the edge 24 of the body 20, to make it possible for the assembly of the cup 12 inside the guide 16, radially formed by the lower end of the body 20 of the guide 16.

The rails 32 each include two rectilinear and parallel edges that extend axially along the axis O.

The head 18 of the guide 16 will be described in detail below with reference to the embodiment according to the invention.

The mechanism 10 includes a second element formed by a sheath 34 that has a generally cylindrical shape.

The sheath 34 includes axially an edge 36 at the upper end thereof and the lower end thereof forms a sleeve configured to form an actuating knob 38.

The knob 38 includes an outer cylindrical surface provided with a set of striations 40 that extend axially, parallel to one another, in this case over the entire circumference of the knob 38.

The striations 40 of the knob 38 of the sheath 34 of the mechanism 10 are intended to cooperate with the splines 122 of the base 104 of the case 100.

In the example, the striations 40 of the sheath 34 and the splines 122 of the base 104 form the gearing means 120.

Preferably, the sheath 34 is mounted axially on the body 20 of the guide 16 by snap-fitting.

The sheath 34 surrounds the body 20 of the guide 16. The sheath 34 is axially blocked between the lower face 28 of the collar 22 of the guide 16 that forms an upper abutment for the edge 36 of the sheath 34 and the lower edge 24 of the body 20 of the guide 16.

The sheath 34 includes at least one helical groove 42 arranged in an inner wall 44.

In the example, the sheath 34 includes two helical grooves 42 that are each intended to cooperate with the lugs 14 of the cup 12.

The lugs 14 of the cup 12 radially pass through the axial rails 32 of the guide 16 so that each cooperates with one of the helical grooves 42 of the sheath 34.

The gearing means 120 enable any movement of rotation about the axis O applied by a user on the lower part 114 of the base 104 to be directly transmitted to the mechanism 10, more specifically transmitted to the knob 38 of the sheath 34 of the mechanism 10.

The rotational driving of the sheath 34 thus causes an axial movement of the cup 12, which is thus moved between the retracted position and application position.

Preferably, the sheath 34 includes angular indexation means such as a small slit 45.

The mechanism 10 includes a sleeve 46 intended to extend axially around the cosmetic product. The sleeve 46 delimits an inner volume intended to receive the cosmetic product.

The mechanism 10 according to the embodiment example shown in the figures is more specifically intended to receive a cosmetic product that has a "soft" to "very soft" formulation.

In the case of a cosmetic product with a "soft" to "very soft" formulation, the cosmetic product is in contact with all or part of the inner wall of the sleeve 46.

Advantageously, the sleeve 46 ensures the support of the cosmetic product.

Such as explained above, the cosmetic product is introduced inside the sleeve 46 during the hot casting of the product, for example through the orifice 119, then the cup 12, and finally the sleeve 46.

Advantageously, the sleeve 46 is made of a metal material, such as anodised aluminium.

The use of a metal material to produce the sleeve 46 makes it possible, because of the good thermal conductivity of such materials, to achieve a quicker cooling of the hot cast cosmetic product filling the inner volume of the sleeve 46.

Advantageously, the reduced cooling time makes it possible to reduce the production cycle time and improves the appearance of the cosmetic product, the appearance being, in particular, smoother.

The sleeve 46 includes an upper edge 48, in this case bevelled, and located axially opposite thereto, a lower edge 50 with a circular shape.

The sleeve 46 has an outer cylindrical surface 52 wherein is arranged at least one opening 54 intended to secure the sleeve 46 to the head 18 of the guide 16.

In the embodiment, the sleeve 46 includes two openings 54 that are arranged diametrically opposite one another.

Figure 5:
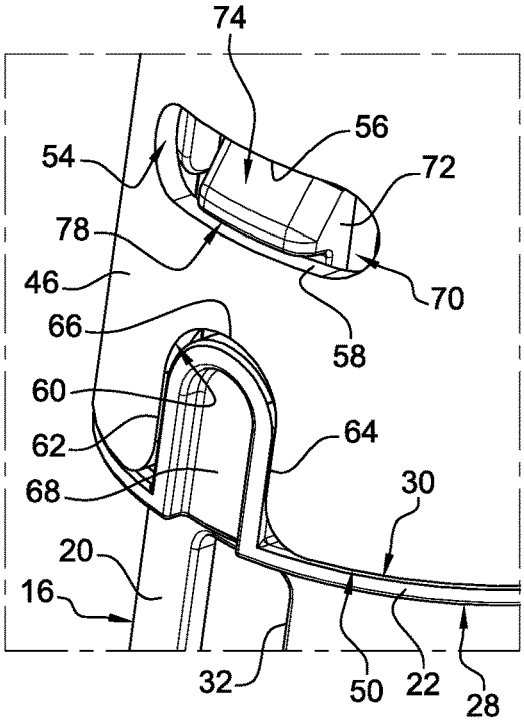
FIG. 5 is a perspective and detailed view of the free end of one of the flexible tabs of the head of the guide inserted in an associated opening of the sleeve and which illustrates the cooperation between the lower immobilising face of the tab and the associated lower edge of the opening to axially immobilise the sleeve with respect to the guide and, on the other hand, the cooperation between the rotational blocking finger secured to the guide and the associated indentation of the sleeve.

The opening 54, in this case, extends circumferentially along a generally oblong shape and is delimited axially by an upper edge 56 and a lower edge 58 which, respectively straight, are more specifically shown in FIGS. 4 and 5.

In the embodiment, the sleeve 46 includes at least one indentation 60 that opens axially downwards on a lower edge 50 of the sleeve 46.

The indentation 60 generally has the shape of an inverted "U", the indentation 60 including a first edge 62 and a second edge 64 that extend axially and are connected by an upper edge 66, which here is curvilinear.

Preferably, the indentation 60 is arranged axially under, and aligned with one of the openings 54 of the sleeve 46.

According to one aspect of the invention, the head 18 of the guide 16 includes rotational blocking means 68 intended to cooperate with the complementary means 60 of the sleeve 46 to block the sleeve 46 rotationally with respect to the guide 16.

In the embodiment shown in the figures, the blocking means 68 includes at least one finger which is intended to be received axially in the at least one indentation 60 of the sleeve 46.

The rotational blocking finger 68 extends axially upwards from the upper surface 30 of the collar 22 against which the lower edge 50 of the sleeve 46 is likely to abut, in particular during assembly.

Such as shown in FIG. 5 in particular, the finger 68 of the guide 16 has a shape that fits with that of the indentation 60 of the sleeve 46.

According to another aspect of the invention, the head 18 of the guide 16 includes attachment means 70 configured to cooperate with the complementary means 54 of the sleeve 46 to immobilise axially the sleeve 46 with respect to the guide 16.

According to the invention, the mechanism 10 includes a guide 16 including attachment means 70, by snap-fitting, configured to cooperate with complementary means 54 of the sleeve 46 to axially immobilise the sleeve 46 with respect to the guide 16 and rotational blocking means 68 intended to cooperate with the complementary means 60 of the sleeve 46 to block the sleeve 46 rotationally with respect to the guide 16.

Advantageously, the attachment means 70 are constituted by at least one flexible tab, elastically deformable in the radial direction, which is intended to cooperate with a part of the sleeve 54 to axially immobilise the sleeve 46 with respect to the guide 16.

Preferably, the blocking finger 68 is arranged axially under and aligned with the at least one flexible tab 70 in order, in particular, to facilitate the mould-stripping of the guide 16 and more particularly of the head 18 forming the upper part thereof.

Such as indicated above, the indentation 60 intended to receive the blocking finger 68 is arranged axially under, and aligned with one of the openings 54 of the sleeve 46.

Preferably, the snap-fitting attachment means 70 include at least two flexible tabs that are elastically deformable in a radial direction.

Figure 6:
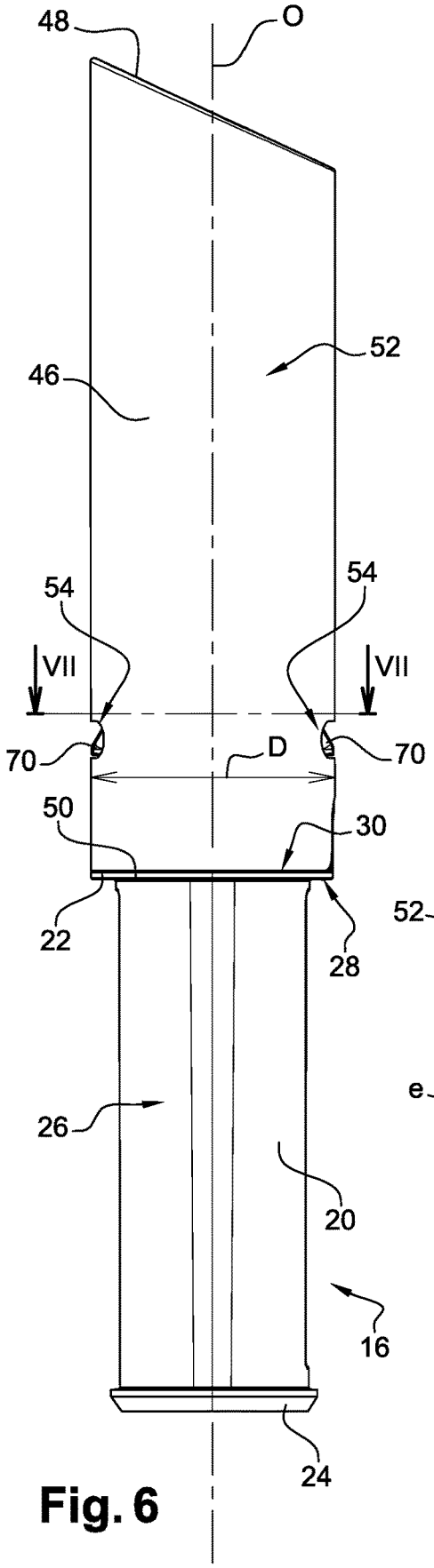
FIG. 6 is a side view which shows the sleeve and the guide according to FIG. 4 after assembly and which illustrates the fact that the flexible tabs do not protrude beyond the opening so as to not modify the outer diameter of the sleeve of the mechanism.

Such as shown in FIGS. 5 and 6, a flexible tab 70 includes a free end 72 that is received after assembly in one of the associated openings 54 of the sleeve 46 in order to axially immobilise the sleeve 46 with respect to the guide 16.

Advantageously, the rotational blocking means 68 of the sleeve 46 are separate from the attachment means 70 of the sleeve 46 and preferably formed by the at least two flexible tabs 70.

In the embodiment, the at least two flexible tabs 70 are arranged on the head 18 of the guide 16 and diametrically opposite one another.

Advantageously, the attachment of the sleeve 46 on the head 18 of the guide 16 is achieved by snap-fitting, in this case by the cooperation of the flexible tabs 70 secured to the head 18 of the guide 16 with the openings 54 of the sleeve 46.

The snap-fitting of the sleeve 46 on the head 18 of the guide 16 offers an alternative to the gluing and/or crimping according to the state of the art.

As the guide 16 and the sleeve 46 are separate parts, each can be advantageously made of a different material, preferably a metal material for the sleeve 46 and a plastic material for the guide 16.

The use of a metal material for the sleeve 46 is advantageous for aesthetic and technical reasons, providing in particular for the improved cooling of the cosmetic product after casting.

The use of a plastic material for the guide 16 is advantageous for technical reasons, by making it possible for a production process by injection moulding of one single part, as well as for cost-related reasons.

Advantageously, the attachment by snap-fitting of the sleeve 46 on the head 18 of the guide 16 constitutes a simple, reliable and cost-effective solution to axially connect the sleeve 46 and the guide 16 of the mechanism 10 to one another.

Such as shown in the figures, the at least two flexible tabs 70 extend advantageously in an axial direction, i.e. along the axis O of the mechanism 10, the axial direction corresponding to the assembly direction along which the sleeve 46 and the guide 16 are secured to one another.

Advantageously, the free end 72 of each flexible tab 70 includes at least one upper assistance face 74 which is configured to facilitate the elastic deformation of the tab 70 radially outwards, during the assembly of the sleeve 46 with the guide 16 along the axial direction.

During the axial assembly of the sleeve 46 to the guide 16, the lower edge 50 of the sleeve 46 cooperates with the upper assistance face 74, which is inclined to cause, under stress, the radial inwards movement thereof.

The free end 72 of the flexible tab 70 has a cross-section with a generally triangular shape.

Advantageously, the head 18 of the guide 16 includes a cut-out 76 to make it possible for a range of movement of each of the flexible tabs 70 radially inwards.

The elastic deformation of the flexible tabs 70 along the radial direction during the axial assembly of the sleeve 46 on the guide 16 is particularly advantageous, making it possible to avoid damage to the flexible tabs 70.

More specifically, the fact that the flexible tabs 70 are elastically deformable along the radial direction makes it possible to avoid the lower edge 50 of the sleeve 46 from causing damage thereto during assembly.

Indeed, the sleeve 46, preferably made of a metal material, generally has a reduced thickness, for example of around 0.3 mm.

Thus, the lower edge 50 of the sleeve 46 forms, with respect to the tabs 70, a "sharp" element that is likely to "cut" or "shear" them during assembly, like a blade.

Yet, such damage to the flexible tabs 70 would then be likely to affect the reliability of the attachment by snap-fitting of the sleeve 46 to the guide 16.

After an initial assembly phase during which the flexible tabs 70 are radially stressed inwards by the sleeve 46, the flexible tabs 70 are then elastically returned radially outwards, during a final assembly phase, to each be automatically housed in one of the associated openings 54 of the sleeve 46.

In the embodiment, the free end 72 of each flexible tab 70 includes at least one lower immobilising face 78 which is configured to cooperate with the associated lower edge 58 of the opening 54 of the sleeve 46 so as to axially immobilise the sleeve 46 with respect to the guide 16.

Advantageously, the flexible tabs 70 are locked in the openings 54 after insertion, so as to achieve a non-removable attachment of the guide 16 to the sleeve 46.

Figure 7:
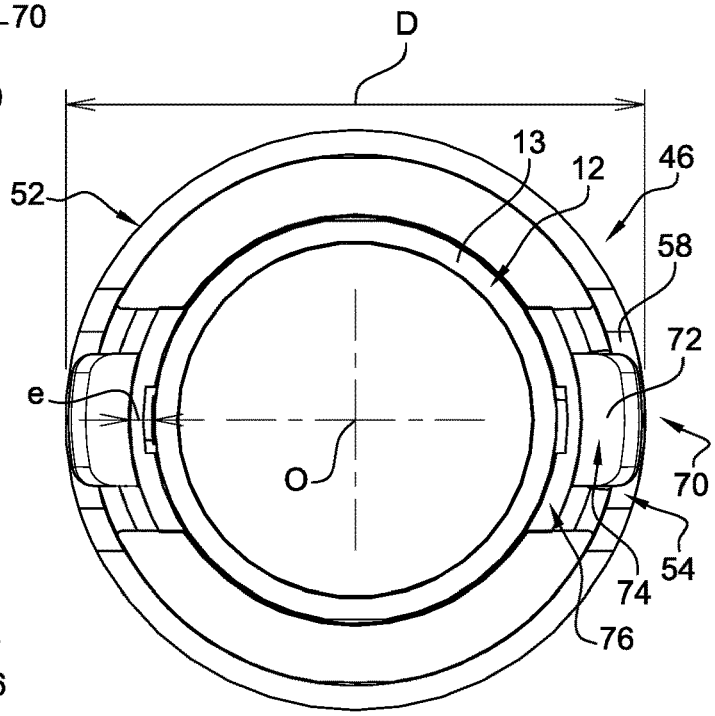
FIG. 7 is a cross-sectional view along the radial plane VII-VII shown in FIG. 6 and illustrates the flexible tabs that are included in the dimensions of the diameter D of the sleeve.

Such as shown in FIGS. 6 and 7, the flexible tabs 70 are, in an assembled position of the sleeve 46 with the guide 16, included radially inside the outer diameter D of the sleeve 46.

Advantageously, the outer diameter of the guide 16 at the level of the flexible tabs 70 is, in an assembled position, less than or equal to the outer diameter D of the sleeve 46.

The flexible tabs 70 therefore do not protrude radially outwards beyond the openings 54 and therefore do not change the outer diameter D of the sleeve 46 defined by the cylindrical outer surface 52.

Advantageously, the snap-fitting attachment does not affect the general dimensions of the mechanism 10, the mechanism 10 thereby conserving the same outer diameter D as before.

More generally, the outer diameter of the guide 16 radially has an extremum that is less than or equal to the outer diameter D of the sleeve 46, in particular at the level of the head 18, and including that of the collar 22.

In the embodiment and such as described above, the blocking finger 68 is arranged axially under, and aligned with one of the flexible tabs 70 forming the attachment means, as is the case with the indentation 60, which is aligned with one of the openings 54.

Advantageously, the rotational blocking means are configured to angularly index with respect to the axis O the position of the sleeve 46 relative to the head 18 of the guide 16 so as to position each of the openings 54 radially opposite the free end 72 of one of the flexible tabs 70.

Indeed, when the blocking finger 68 of the guide 16 is axially aligned with the indentation 60 of the sleeve 46, the openings 54 are thus also correctly positioned for the free ends 72 of each of the elastically-deformable flexible tabs 70 to engage radially in the corresponding opening 54.

The head 18 of the guide 16 includes an upper end which, intersected by cut-outs 76 provided for the two flexible tabs 70, is mainly constituted by two parts 80 that circumferentially delimit a central orifice 82 of the guide 16.

Such as shown in FIGS. 2 and 3, the central orifice 82 of the guide 16 is passed through by the upper part of the cup 12.

Advantageously, the head 18 of the guide 16 includes at least two ribs 84 for guiding the sleeve 46.

The guiding ribs 84 make it possible to axially guide the sleeve 46 during the assembly thereof on the head 18 of the guide 16, in particular when assembly operations are performed automatically by a machine.

The guiding ribs 84 are radially in contact with the sleeve 46, which is thus mounted by tightening, making it possible to limit to a minimum the presence of clearances that could cause incidents during assembly.

Preferably, the ribs 84 are arranged diametrically opposite one another.

In the embodiment, the two guiding ribs 84 are angularly offset with respect to the flexible tabs 70, for example by an angle of 90°.

Advantageously, the sleeve 46 is tightly mounted on the head 18 of the guide 16, in particular using the guiding ribs 84.

Preferably, the inner wall of the sleeve 46 also cooperates with other parts of the head 18 of the guide in addition to the guiding ribs 84.

In the embodiment example, the inner wall of the sleeve 46 advantageously cooperates with the two upper parts 80 and with a lower part of the head 18, the guiding ribs 84 extending axially between one of the uppers parts 80 and the lower part.

Such as shown in particular in FIG. 4, the lower part of the head 18 is located above the collar 22 and includes, in this case, all or part of the rotational blocking finger 68.

Such as described previously, the guide 16 is advantageously made of a plastic material.

The attachment means 70 formed by at least one flexible tab 70, and the blocking means 68 formed by at least one finger 68 are made of one single part integrally formed with the guide 16.

In addition, the use of a plastic material is also advantageous to obtain elastically-deformable flexible tabs 70.

Advantageously, the flexible tabs 70, after assembly, ensure a non-removable attachment of the sleeve 46 on the head 18 of the guide 16.

Such as shown in FIG. 7, the head 18 of the guide 16 is configured such that the flexible tabs 70 have radially a space "e" with respect to the cup 12, which is determined to obtain a non-removable attachment of the sleeve 46 to the guide 16.

Advantageously, the space "e" is determined to obtain a non-removable attachment between the sleeve 46 and the guide 16, the flexible tabs 70 not being able to radially exit from the openings 54 once the assembly of the cup 12 is completed, as the space "e" is thus insufficient.

After having assembled the sleeve 46 and the guide 16 to secure them by snap-fitting, the assembly of the cup 12 thus locks the flexible tabs 70 in an attachment position.

Once the assembly of the cup 12 is completed, the space "e" is insufficient such that the tabs 70 can be moved radially and be released from the openings 54 of the sleeve 46.

Advantageously, such a space "e" also makes it possible to avoid all contact of the flexible tabs 70 with the cup 12, thanks to which, in the absence of interference, any influence on the torque applied to cause the movement of the cup 12 is not affected.

The embodiment which has just been described above with reference to FIGS. 1 to 7 is however given in a non-limiting manner.

In particular, the snap-fitting attachment means could include only one flexible tab 70.

Indeed, the flexible tabs 70 forming the snap-fitting attachment means 70 are likely to be modified.

Figure 8:
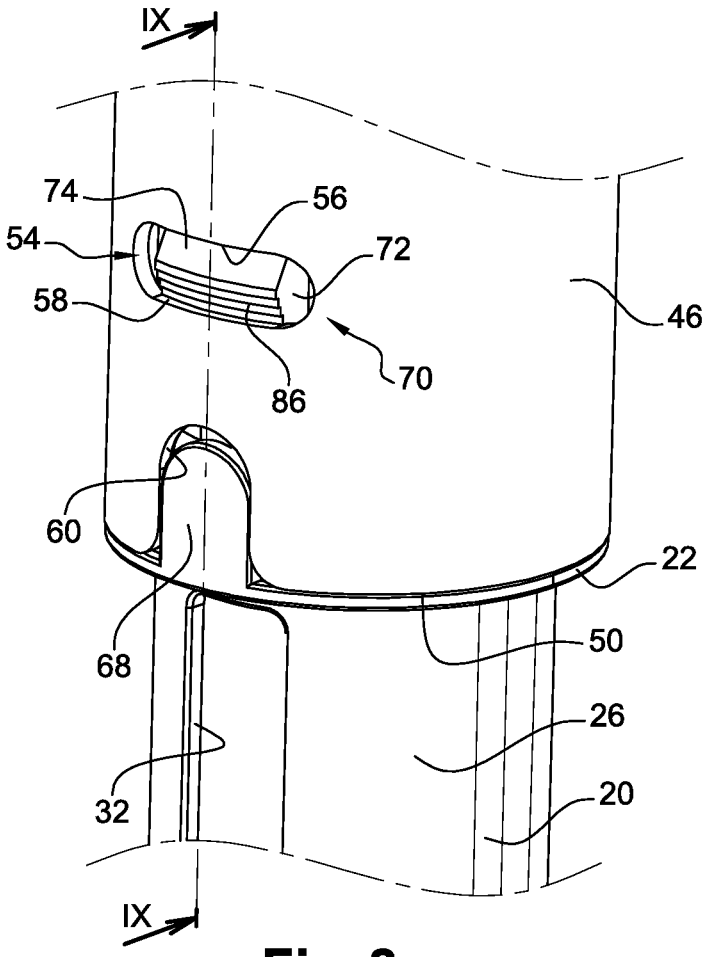
FIG. 8 is a perspective view which shows another embodiment version wherein each of the flexible tabs is provided with a series of notches and which illustrates the notched free end of one of the flexible tabs engaged in one of the associated openings of the sleeve.
Figure 9:
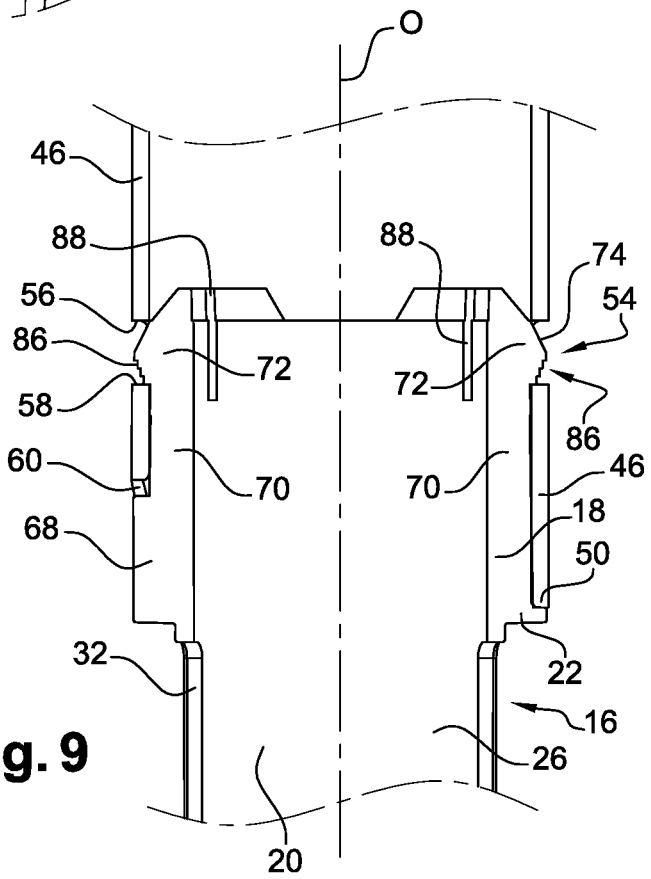
FIG. 9 is a cross-sectional view along the plane IX-IX shown in FIG. 8 which shows the version of the embodiment shown in FIGS. 1 to 7, and which illustrates the cooperation between one of the notches of a flexible tab and the lower edge of one of the openings of the sleeve.

In another alternative of the embodiment shown in FIGS. 8 and 9, the at least one lower face 78 immobilising the at least one flexible tab 70 forming the attachment means includes at least one notch 86.

Preferably, the lower immobilising face 78 of the deformable flexible tab 70 includes a plurality of parallel notches 86 intended to cooperate with the lower edge 58 of the opening 54 of the sleeve 46.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, elements, and/or components, but do not preclude the presence or addition of one or more other elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A mechanism for a case for applying a cosmetic product comprising a lipstick, having a main axis, said mechanism comprising:

one cup intended to receive said cosmetic product, said cup comprising at least one lug;

one guide comprising a head extended by a body wherein the cup is movably mounted, said body of the guide comprising at least one rail on which slides said at least one lug of the cup, one sheath mounted around the body of the guide and comprising at least one helical groove which cooperates with said at least one lug of the cup by sliding on said at least one rail of the guide when the sheath is rotationally driven with respect to the guide to cause an axial motion of the cup, and one sleeve intended to extend axially around the cosmetic product, said sleeve being mounted around said head of the guide to which said sleeve is secured, wherein the head of the guide comprises:

attachment means by snap-fitting configured to cooperate with complementary means of the sleeve in order to axially immobilize said sleeve with respect to the guide, the attachment means comprising at least one flexible tab and a configuration to obtain a non-removable attachment; and rotational blocking means intended to cooperate with the complementary means of the sleeve to block said sleeve rotationally with respect to the guide.

2. The mechanism according to claim 1, said at least one flexible tab comprising a free end received in an associated opening of the sleeve to axially immobilize said sleeve with respect to the guide.

3. The mechanism according to claim 2, wherein said at least one flexible tab extends in a radial direction.

4. The mechanism according to claim 2, wherein the free end of said at least one flexible tab comprises an upper assistance face configured to facilitate the elastic deformation of said tab, radially inwards, when the sleeve cooperates with said upper assistance face during the axial assembly of said sleeve with the guide.

5. The mechanism according to claim 2, wherein the free end of said at least one flexible tab comprises at least one lower immobilizing face configured to cooperate with an associated edge of the opening of the sleeve so as to axially immobilize the sleeve with respect to the guide.

6. The mechanism according to claim 5, wherein said at least one lower immobilizing face comprises at least one notch.

7. The mechanism according to claim 2, wherein the outer diameter of the guide at the level of said at least one flexible tab is, in an assembled position, less than or equal to the outer diameter of the sleeve.

8. The mechanism according to claim 2, wherein the head of the guide is configured such that said at least one flexible tab has, radially with respect to the cup, a space that is determined to obtain a non-removable attachment of the sleeve on the head of the guide.

9. The mechanism according to claim 2, wherein the rotational blocking means are configured to index the position of the sleeve with respect to the head of the guide so as to angularly position each of the openings radially opposite the free end of said at least one flexible tab.

10. The mechanism according to claim 1, wherein the rotational blocking means comprise at least one axial finger which, in an assembled position, is received in an indentation of the sleeve.

11. The mechanism according to claim 1, wherein the head of the guide comprises at least two ribs for guiding the sleeve.

12. A case for applying a cosmetic product comprising a lid, a base which comprises a mechanism comprising:

one cup intended to receive said cosmetic product, said cup comprising at least one lug;

one guide comprising a head extended by a body wherein the cup is movably mounted, said body of the guide comprising at least one rail on which slides said at least one lug of the cup, one sheath mounted around the body of the guide and comprising at least one helical groove which cooperates with said at least one lug of the cup by sliding on said at least one rail of the guide when the sheath is rotationally driven with respect to the guide to cause an axial motion of the cup, and one sleeve intended to extend axially around the cosmetic product, said sleeve being mounted around said head of the guide to which said sleeve is secured, wherein the head of the guide comprises:

attachment means by snap-fitting configured to cooperate with complementary means of the sleeve in order to axially immobilize said sleeve with respect to the guide, the attachment means comprising at least one flexible tab and a configuration to obtain a non-removable attachment, and rotational blocking means intended to cooperate with the complementary means of the sleeve to block said sleeve rotationally with respect to the guide, wherein in the sheath of the mechanism is rotationally connected to the base of the case.

* * * * *